US007210913B2

(12) United States Patent
Midorikawa

(10) Patent No.: US 7,210,913 B2
(45) Date of Patent: May 1, 2007

(54) SCROLL FLUID MACHINE WITH A SILENCER

(75) Inventor: Youhei Midorikawa, Tokyo (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/387,941

(22) Filed: Mar. 23, 2006

(65) Prior Publication Data

US 2006/0222548 A1 Oct. 5, 2006

(30) Foreign Application Priority Data

Mar. 30, 2005 (JP) ..... 2005-099350

(51) Int. Cl.
*F01C 1/02* (2006.01)

(52) U.S. Cl. ..... 418/55.1; 418/55.2; 418/181

(58) Field of Classification Search ..... 418/55.1, 418/55.2, 181

See application file for complete search history.

(56) References Cited

U.S. PATENT DOCUMENTS

| | | | | |
|---|---|---|---|---|
| 6,158,989 | A * | 12/2000 | Barito | 418/55.1 |
| 6,176,094 | B1 * | 1/2001 | Ohta et al. | 62/114 |
| 6,220,839 | B1 * | 4/2001 | Sheridan et al. | 418/55.1 |
| 6,736,620 | B2 * | 5/2004 | Satoh | 418/6 |
| 2004/0105770 | A1 * | 6/2004 | Sakamoto et al. | 418/5 |

* cited by examiner

*Primary Examiner*—Hoang Nguyen
(74) *Attorney, Agent, or Firm*—Ostrolenk, Faber, Gerb & Soffen, LLP

(57) ABSTRACT

A scroll fluid machine comprises a housing, a drive shaft, a stationary scroll fixed to the housing, and an orbiting scroll driven by the drive shaft. A gas from the outer circumference of the housing is introduced between the stationary and orbiting scrolls, and sent to the center by revolving the orbiting scroll in engagement with the stationary scroll. On the rear surface of the stationary scroll, there are provided a plurality of cooling fins that radially extend. Between the adjacent cooling fins, a silencer is provided to prevent noise caused by discharge of the gas.

4 Claims, 5 Drawing Sheets

SCROLL FLUID MACHINE WITH A SILENCER

BACKGROUND OF THE INVENTION

This invention relates to a scroll fluid machine with a silencer that reduces as much as possible noise caused by the discharge of a compressed gas during operation.

A scroll fluid machine itself is known among those skilled in the art. In order to more easily understand the present invention, an example of the basic construction will be explained with reference to FIG. 6.

FIG. 6 is a vertical cross-sectional view of a known scroll fluid machine in which, by having an orbiting scroll with a fixed amount of eccentricity move in an orbiting motion inside a housing, a gas is sucked in from the outside of the housing and directed to a compression section that is formed by a combination of an orbiting scroll and stationary scrolls, and after becoming compressed by moving toward the center, the gas is discharged from the center.

The housing 21 which has a disk-shaped sealed compression chamber 22 comprises a casing 23 and cover 24, and has an inlet hole 25 formed in its outer circumferential surface.

Both the casing 23 and cover 24 have stationary end plates 26, 27 that are located on both sides of the compression chamber 22 so that they face each other, and spiral stationary wraps 28, 29 are formed on the inner surfaces of these end plates that face toward the side of the compression chamber 22, and form stationary scrolls 30, 31.

An orbiting scroll 32 is located inside the compression chamber 22 between both of the stationary end plates 26, 27 so that it moves in an orbiting motion around the axis of the compression chamber 22.

The orbiting scroll 32 has orbiting wraps 34, 35 that are formed on both surfaces of an orbiting end plate 33, fit inside and engage with the stationary scrolls 30, 31 and are 180° with respect thereof. The orbiting scroll 32 is supported by bearings 40, 41 so that it can turn around the eccentric shaft portion 39 of a drive shaft 38, which is fitted inside the center of the housing 21 by bearings 36, 37.

The orbiting end plate 33 is linked to the stationary end plates 26, 27 by way of three known pin-crank-type self-rotation-prevention mechanisms (not shown) that are evenly spaced from each other and located around the same circumference. When the drive shaft 38 rotates, the orbiting end plate 33 moves in an eccentric orbiting motion inside the compression chamber 22 so that the dimension in the radial direction of the space between the stationary wraps 28, 29 and orbiting wraps 34, 35, which are engaged with each other, changes.

An outlet hole 43 is formed in the stationary end plate 27 at a location near the center of the casing 23. The inner end of the outlet hole 43 opens at a location near the center of the pressure chamber 22, and the outer end is closed off by a stopper 42.

Also, a discharge hole 44 is formed radially of the stationary end plate 27 so that it extends from the outlet hole 43 to the outer surface, and a exhaust joint 45 with a check valve fits into the outer end radially of this discharge hole 44.

The drive shaft 38 is driven by a motor (not shown), and cooling fans 46, 47 are installed on the drive shaft 38 outside the casing 23 and the cover 24.

A plurality of radial cooling fins 48, 49 protrude from the rear surface of the casing 23 and cover 24.

As the drive shaft 38 rotates, the orbiting scroll 32, which is supported so that it turns around the eccentric-shaft portion 39, moves in an orbiting motion while still being engaged with the stationary scrolls 30, 31 with a constant amount of eccentricity. As it moves, a gas is sucked in from an inlet hole 25, compressed inside the compression chamber 22 and directed toward the center, where it is finally discharged from the compression chamber 22 by way of the outlet hole 43, discharge hole 44 and exhaust joint 45.

The sound of the exhaust gas that is discharged from the discharge hole 44 and exhaust joint 45 has a considerably high pitch, so normally a suitable silencer 50 is installed in the outlet of the discharge hole 44 or exhaust joint 45.

However, the silencer 50 protrudes outward in the axial or radial direction of the scroll fluid machine itself, so the dimensions of the scroll fluid machine are increased by that amount, which hinders handling and installation of the machine.

SUMMARY OF THE INVENTION

The object of the present invention is to provide a scroll fluid machine with a silencer that does not protrude outward from the scroll fluid machine, or does not change the shape or dimensions of the scroll fluid machine.

DETAILED DESCRIPTION OF THE PREFERRED EMBODIMENTS

Figure 1:
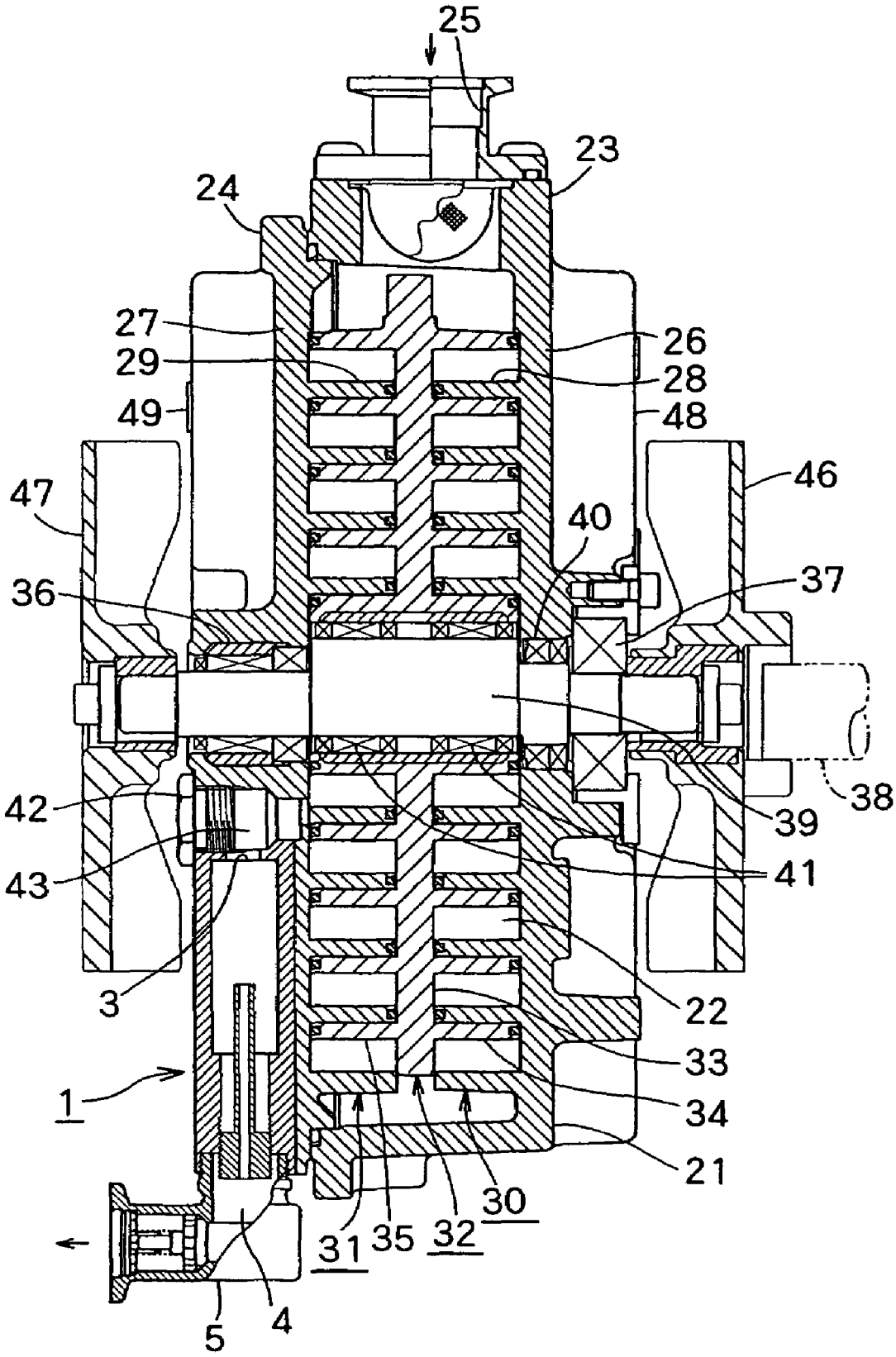
FIG. 1 is a vertical cross-sectional view showing the first embodiment of a scroll fluid machine according to the present invention.
Figure 2:
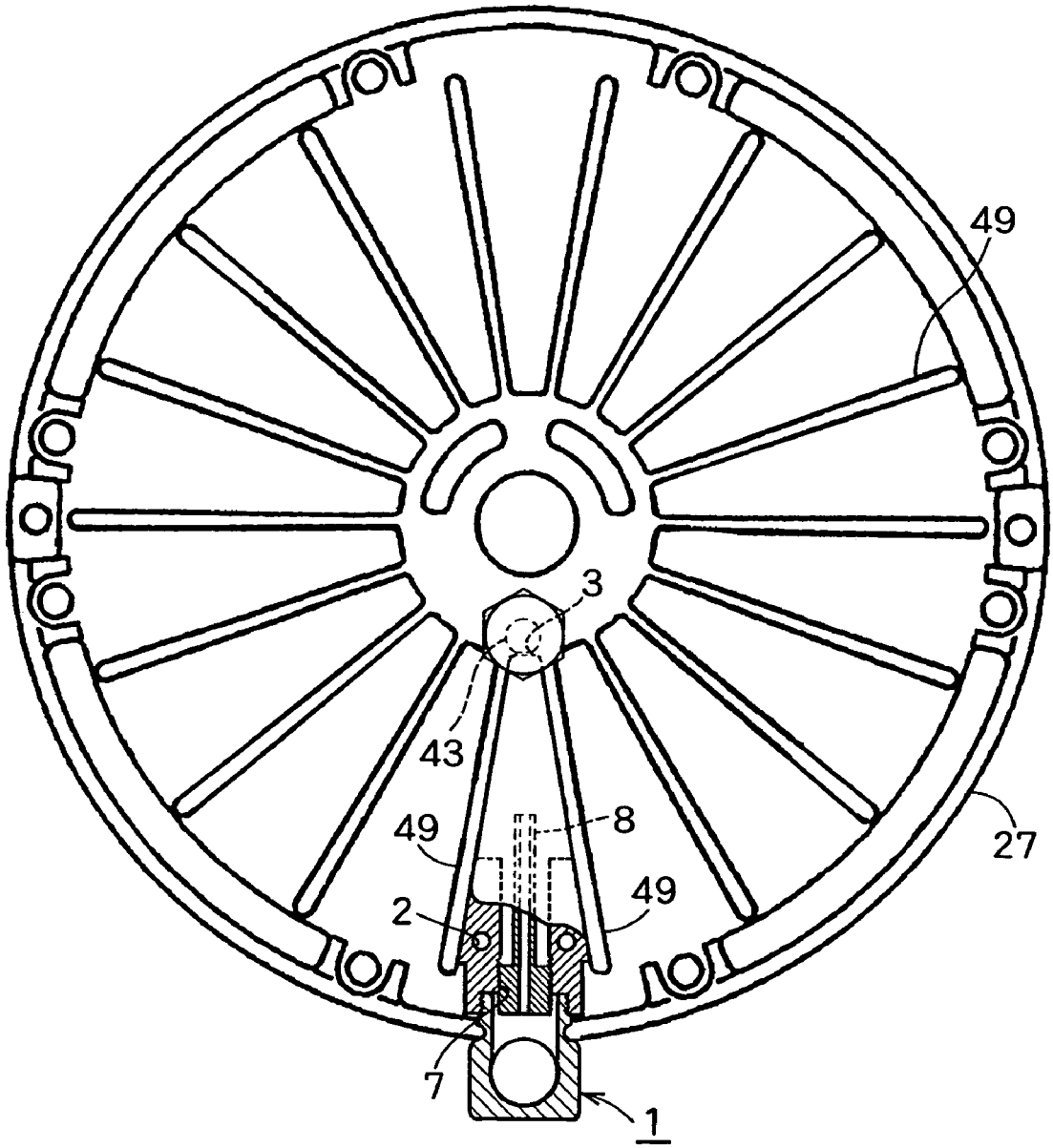
FIG. 2 is a rear view of the stationary scroll shown in FIG. 1.
Figure 3:
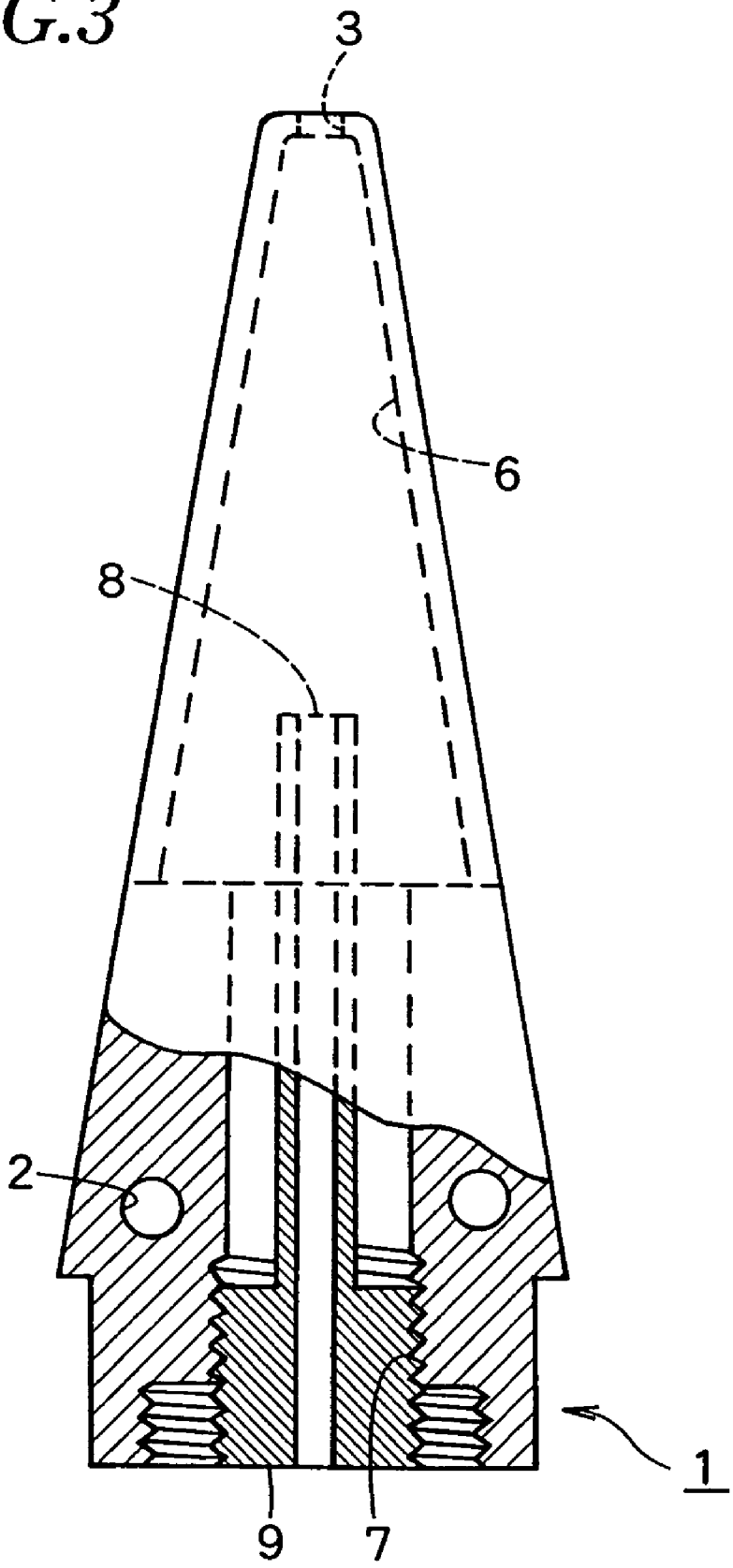
FIG. 3 is a view showing a cylindrical silencer shown in FIGS. 1 and 2.

FIGS. 1 to 3 show the first embodiment of a scroll fluid machine according to the present invention.

Figure 6:
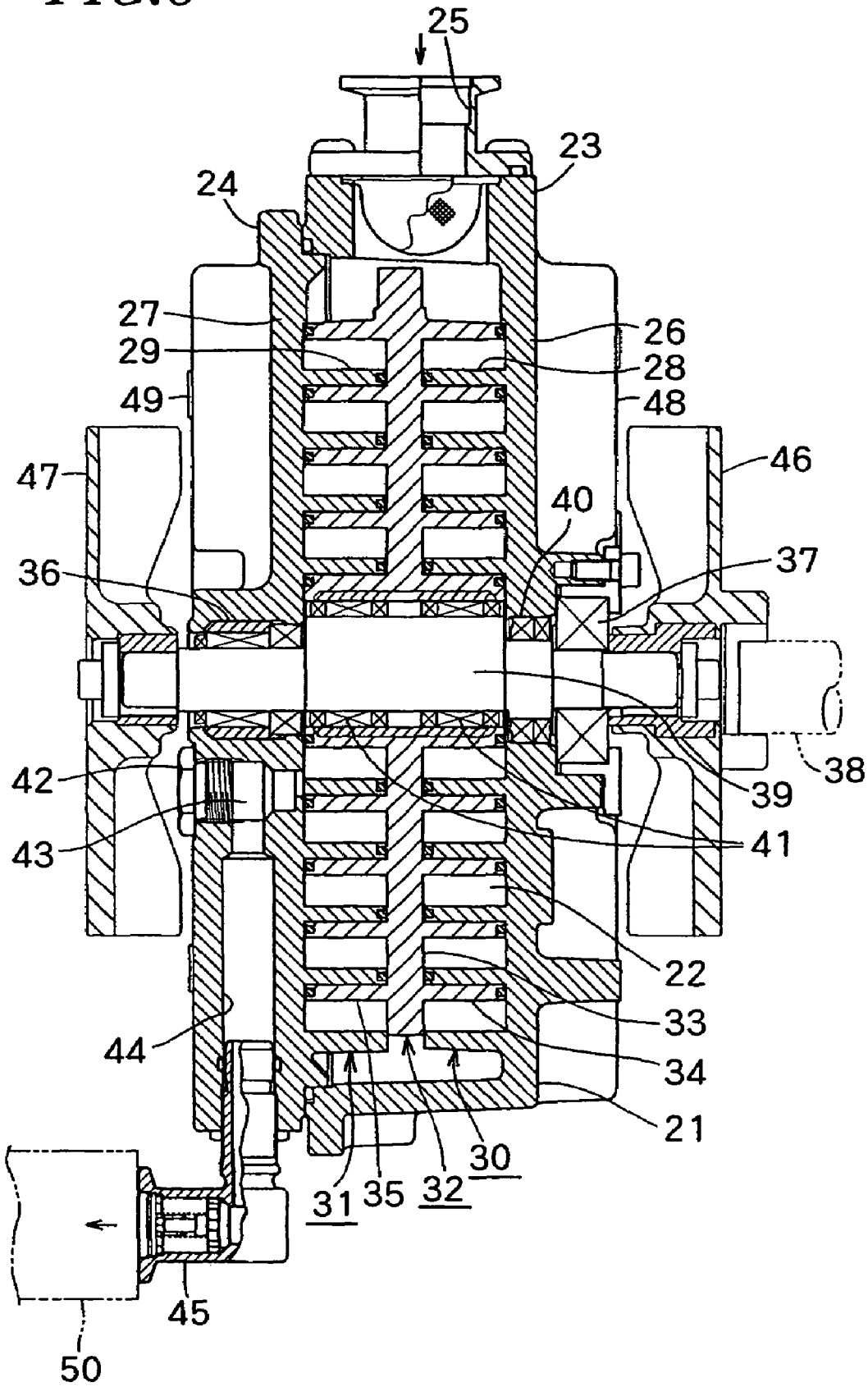
FIG. 6 is a vertical cross-sectional view of a known scroll fluid machine.

Except for the installation of a cylindrical silencer, the embodiment shown in FIG. 1 to FIG. 3 is the same as the scroll fluid machine that is shown in FIG. 6. Therefore, in FIGS. 1 to 3, the same reference numerals will be allotted to elements that are the same as those in FIG. 6, and description thereof will be omitted, so that only what are different will be described.

A cylindrical expansion-decompression type silencer 1, having a thin, fan-shaped appearance, is suitably fitted between any arbitrary pair of adjacent radial cooling fins 49 that protrude from the rear surface of a stationary end plate 27 of a stationary scroll 31. The silencer 1 is fastened with a suitable screw 2, adhesive or the like.

The cylindrical silencer 1 is nearly the same height as the cooling fins 49, or a little lower, where an inflow hole 3 thereof is connected to an outlet hole 43 formed in the stationary scroll 31, and a discharge hole 4 thereof is located in the outer perimeter area of the stationary scroll 31.

An exhaust joint 5 is connected to the discharge hole 4 of the cylindrical silencer 1.

The silencer 50 connected to the outlet of the exhaust joint 45 in FIG. 6 is omitted.

As shown in the enlarged view of FIG. 3, the cylindrical silencer 1 is such that the inflow hole 3, which faces in the centripetal direction, has a small diameter, and connected to a large-diameter expansion hole 6, and an adjustment nut 9, which has a very small-diameter introduction tube 8 on its inside end, is screwed onto a female thread hole 7 that is formed on the outer end of the expansion hole 6.

As the scroll fluid machine operates, pressurized gas coming from the outlet hole 43 near the center of the machine passes through the smaller-diameter inflow hole 3 of the cylindrical silencer 1 and flows inside the larger-diameter expansion hole 6 where it is decompressed by expansion, and the generation of noise is suppressed.

When changes in the intensity of noise occur due to changes in the operating conditions of the scroll fluid machine, or due to fluctuations in air temperature or the like, it is possible to adjust the effective length of the cylindrical silencer 1 by adjusting the adjustment nut 9 and changing the position in the axial direction of the inlet of the introduction tube 8.

Figure 4:
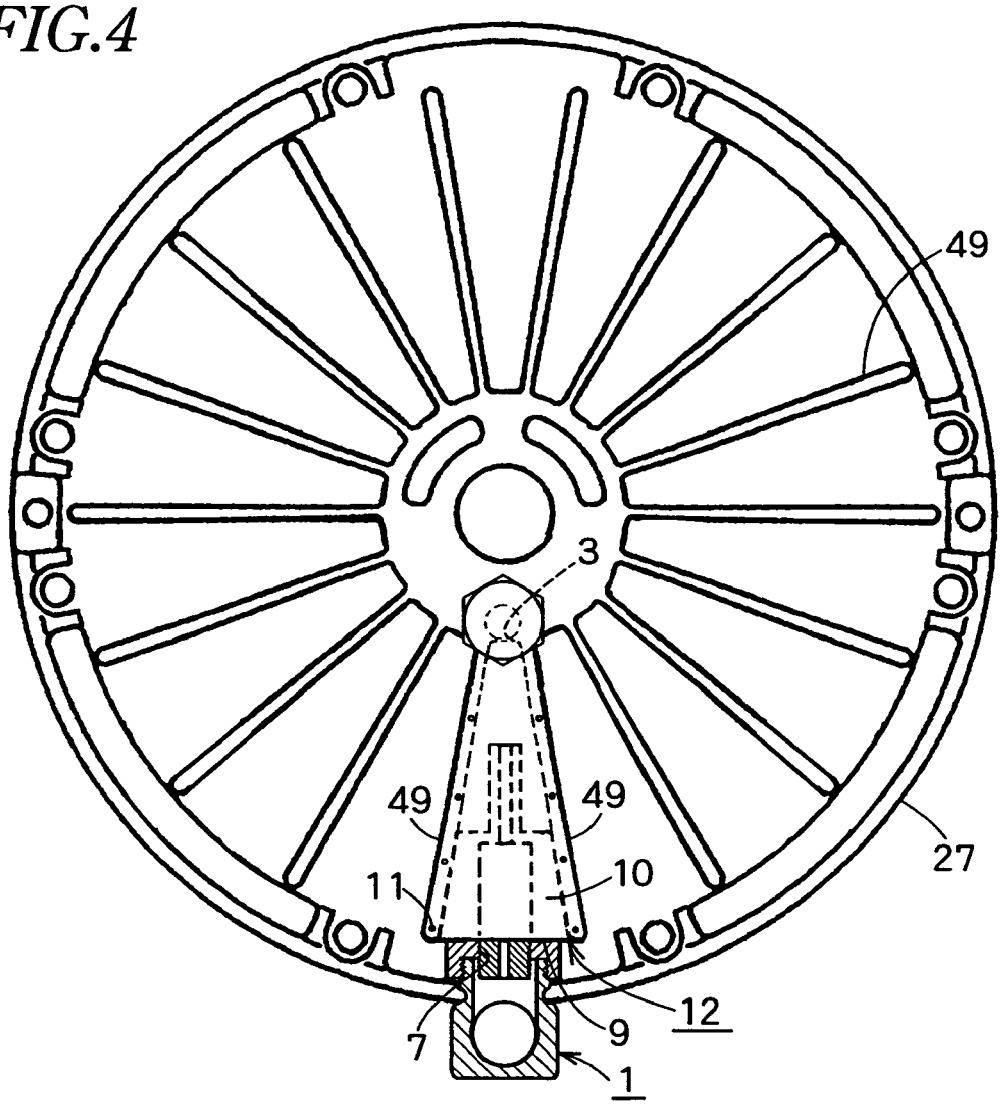
FIG. 4 is a view similar to FIG. 2 and shows the second embodiment of a scroll fluid machine according to the present invention.
Figure 5:
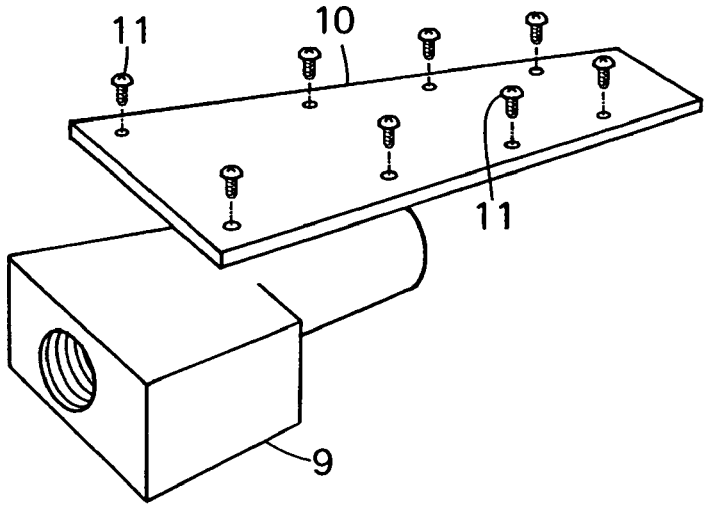
FIG. 5 is an exploded perspective view of the cylindrical silencer shown in FIG. 4.

FIG. 4 and FIG. 5 show the second embodiment of a cylindrical silencer according to the present invention.

A space between adjacent cooling fins 49 and 49 is covered with a cover piece 10 and fixed airtightly with screws 11 to form a tubular silencer 12 surrounded by the cooling fins 49,49 and the cover piece 10.

The construction inside the cylindrical silencer 12 is the same as that shown in FIGS. 2 and 3, so the same reference numbers are applied and a detailed explanation is omitted.

The foregoing relates to embodiments of the invention. Various changes and modifications may be made by a person skilled in the art without departing from the scope of claims wherein:

What is claimed is:

1. A scroll fluid machine comprising:

a housing having an inlet hole in an outer circumference;

a drive shaft having an eccentric shaft portion at one end;

an orbiting scroll comprising an orbiting end plate having an orbiting wrap and rotably mounted around the eccentric shaft portion of the drive shaft;

a stationary scroll fixed to the housing and comprising a stationary end plate having a stationary wrap on a front surface, a plurality of radial cooling fins on a rear surface and an outlet hole near a center, a compression chamber being formed between the stationary and orbiting wraps, said orbiting scroll being revolved with the eccentric shaft portion by the drive shaft to compress a gas sucked from the inlet hole of the housing into the compression chamber by moving the gas towards a center of the orbiting scroll to discharge the gas through the outlet hole of the stationary end plate; and a silencer provided between adjacent ones of the cooling fins and communicating with the outlet hole near the center of the stationary end plate to discharge the gas to an outside, said silencer comprising an expansion hole which extends radially and becomes gradually wider towards an outer circumference of the stationary scroll to allow the compressed gas to pass though the expansion hole from the outlet hole to the outer circumference to discharge the gas.

2. A scroll fluid machine as claimed in claim 1 wherein adjacent cooling fins are airtightly covered with a cover to form the silencer.

3. A scroll fluid machine as claimed in claim 1 wherein a female thread hole is formed at an outer end of the silencer, an adjustment nut being screwed into the female thread hole to adjust prevention of noise effectively.

4. A scroll fluid machine comprising:

a housing having an inlet hole in an outer circumference;

a drive shaft having an eccentric shaft portion at one end;

an orbiting scroll comprising an orbiting end plate having an orbiting wrap and rotatable mounted around the eccentric shaft portion of the drive shaft;

a stationary scroll fixed to the housing and comprising a stationary end plate having a stationary wrap on a front surface, a plurality of radial cooling fins on a rear surface and an outlet hole near a center, a compression chamber being formed between the stationary and orbiting wraps, said orbiting scroll being revolved with the eccentric shaft portion by the drive shaft to compress a gas sucked from the inlet hole of the housing into the compression chamber by moving the gas towards a center of the orbiting scroll to discharge the gas through the outlet hole of the stationary end plate; and a silencer provided between adjacent ones of the cooling fins and communicating with the outlet of the stationary end plate to discharge the gas to an outside, wherein a female thread hole is formed at an outer end of the silencer, an adjustment nut being screwed into the female thread hole to adjust prevention of noise effectively.

* * * * *